US009092002B2

(12) United States Patent
Shimoi

(10) Patent No.: US 9,092,002 B2
(45) Date of Patent: Jul. 28, 2015

(54) IMAGE FORMING APPARATUS

(71) Applicant: CANON KABUSHIKI KAISHA, Tokyo (JP)

(72) Inventor: Yasuhiro Shimoi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/082,619

(22) Filed: Nov. 18, 2013

(65) Prior Publication Data

US 2014/0140727 A1 May 22, 2014

(30) Foreign Application Priority Data

Nov. 21, 2012 (JP) ..... 2012-255108

(51) Int. Cl.
*G03G 21/16* (2006.01)

(52) U.S. Cl.
CPC ..... *G03G 21/1633* (2013.01); *G03G 21/168* (2013.01); *G03G 21/1647* (2013.01)

(58) Field of Classification Search
CPC ..... G03G 21/1623; G03G 21/1633; G03G 21/1638; G03G 21/1647; G03G 21/168; G03G 2215/0054; G03G 2215/0132
See application file for complete search history.

(56) References Cited

U.S. PATENT DOCUMENTS

| | | | | |
|---|---|---|---|---|
| 2006/0093397 | A1* | 5/2006 | Yamaoka | 399/110 |
| 2009/0022514 | A1* | 1/2009 | Fujiwara et al. | 399/121 |
| 2009/0110432 | A1* | 4/2009 | Idehara et al. | 399/107 |
| 2011/0236059 | A1* | 9/2011 | Saito et al. | 399/110 |
| 2013/0108320 | A1* | 5/2013 | Ju et al. | 399/121 |

FOREIGN PATENT DOCUMENTS

JP 2009-251135 A 10/2009

OTHER PUBLICATIONS

Machine translation of 2009251135.*

* cited by examiner

*Primary Examiner* — Clayton E Laballe
*Assistant Examiner* — Ruifeng Pu
(74) *Attorney, Agent, or Firm* — Canon USA Inc IP Division

(57) ABSTRACT

While providing an easy access to a working space between a secondary transfer roller and an intermediate transfer belt, an image forming apparatus is capable of ensuring a working space wider than a rotation radius of the secondary transfer roller in a state that the rotation center portion is pivotally supported on the image forming apparatus side. In a state that a rotation center portion engages with a rotation center hole provided in a housing frame, a secondary transfer unit is rotated on the rotation center hole to position the secondary transfer roller with respect to a secondary transfer counter roller. When the rotation center portion, which is engaged with the rotation center hole, is disengaged accompanying the opening operation of the exterior door, the exterior door supporting the secondary transfer unit is capable of opening widely outward.

6 Claims, 10 Drawing Sheets

FIRST ROTATION STATE

SECOND ROTATION STATE

SECOND ROTATION STATE

FIRST ROTATION STATE

FIRST ROTATION STATE

SECOND ROTATION STATE

FIRST ROTATION STATE

SECOND ROTATION STATE

IMAGE FORMING APPARATUS

BACKGROUND OF THE INVENTION

1. Field of the Invention

The present invention relates to an image forming apparatus including a nip portion for a recording material, which is formed with a first roller member and a second roller member directly or via a belt member.

2. Description of the Related Art

An image forming apparatus, which is widely used, is configured such that a toner image formed on an image bearing member is transferred onto a recording material directly or via an intermediate transfer member, and the recording material bearing the transferred toner image is heated and pressed by a fixing device as an example of an image heating device to fix the image to the recording material. The image forming apparatus includes nip portions for a recording material, which are formed with a first roller member and a second roller member directly or via a belt member in a transfer portion and a fixing device for the recording material carrying a toner image. The image forming apparatus is required to ensure a large working space for removing a jammed recording material by releasing the nip portions when a jam of recording material occurs.

Japanese Patent Application Laid-Open No. 2009-251135 discusses an image forming apparatus including a door member, which is on a rotation shaft horizontally arranged in a lower area thereof, attached on a side surface so that an upper portion of the door member is tilted to open and close. A supporting member on which a secondary transfer roller is rotatably attached is opened and closed parallel to the door member on a rotation shaft arranged in a lower area of the secondary transfer portion of the image forming apparatus. Accompanying a closing movement of the door member, the supporting member of the secondary transfer roller is pushed by the door member to rotate toward the intermediate transfer belt, and thereby a secondary transfer portion is formed between the secondary transfer counter roller and the intermediate transfer belt. Accompanying an opening movement of the door member, the supporting member of the secondary transfer roller rotates outward to release a nip portion between the secondary transfer roller and the intermediate transfer belt, and thereby a working space for removing a jammed recording material is ensured.

According to the image forming apparatus discussed in Japanese Patent Application Laid-Open No. 2009-251135, since the supporting member of the secondary transfer roller is pivotally supported on the image forming apparatus side using a fixed rotation shaft, a working space larger than a rotation radius of the secondary transfer roller provided by the supporting member is not ensured between the secondary transfer roller and the intermediate transfer belt. The supporting member of the secondary transfer roller interferes with access to a working space between the secondary transfer roller and the intermediate transfer belt.

SUMMARY OF THE INVENTION

According to an aspect of the present invention, an image forming apparatus includes a first roller supported by a main body of the image forming apparatus, a second roller configured to contact the first roller directly or via a belt member to form a nip portion nipping a recording material, a door member configured to be opened and closed with respect to the main body, an upper portion of the door member being rotatable around a first rotation shaft to outside the main body, a transfer unit supported by the door member in a state relatively movable with respect to the door member to support the second roller, an urging member provided between the second roller and the transfer unit to urge the second roller toward the first roller when the door member is closed, a first positioning portion provided in the main body for determining a relative positional relationship between a lower portion of the transfer unit and the main body in a state that the door member is closed, a second rotation shaft provided in the transfer unit, which engages with the first positioning portion accompanying a closing movement of the door member to cause an upper portion of the transfer unit to be rotatable, a lock lever provided in the main body to lock the door member to the main body in a closed state, and a lock lever guide mechanism provided in the door member to move and guide the lock lever in a process of the closing movement of the door member.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

<Image Forming Apparatus>

Figure 1:
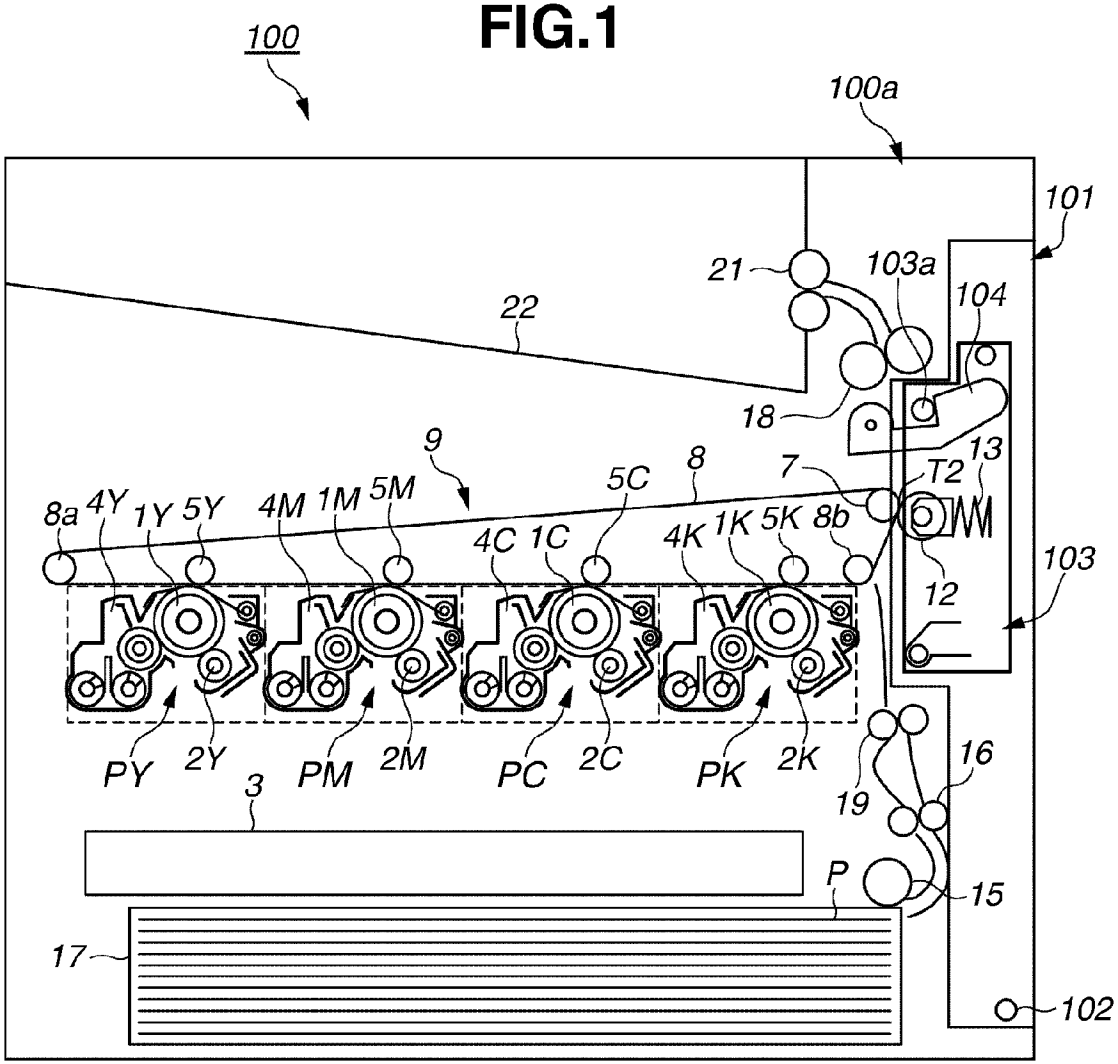
FIG. 1 illustrates a configuration of an image forming apparatus.

FIG. 1 illustrates a configuration of an image forming apparatus. An image forming apparatus 100 is a full color printer of a tandem type intermediate transferring system, including a yellow image forming unit PY, a magenta image forming unit PM, a cyan image forming unit PC, and a black image forming unit PK which are arranged along an intermediate transfer belt 8 as illustrated in FIG. 1.

The image forming unit PY forms a yellow toner image on a photosensitive drum 1Y and primarily transfers the toner image to the intermediate transfer belt 8. The image forming unit PM forms a magenta toner image on a photosensitive drum 1M and primarily transfers the toner image to the intermediate transfer belt 8. The image forming unit PC forms a cyan toner image on a photosensitive drum 1C and primarily transfers the toner image to the intermediate transfer belt 8. The image forming unit PK forms a black toner image on a photosensitive drum 1K and primarily transfers the toner image to the intermediate transfer belt 8.

A sheet of recording material P is taken out one by one from a recording material cassette 17 to stand by at a registration roller 19. The registration roller 19 feeds the recording material P to a secondary transfer portion T2 at timing of the toner image on the intermediate transfer belt 8. The recording material P having the toner image, which is secondarily transferred from the intermediate transfer belt 8 while being conveyed through the secondary transfer portion T2, is conveyed to a fixing device 18 to fix the toner image with heating and pressing by the fixing device 18. The recording material P is then discharged onto a tray 22 located outside of the apparatus.

The image forming units PY, PM, PC and PK are structured substantially identical to each other excepting a point that the colors of toner used in the developing devices 4Y, 4M, 4C and 4K are different from each other as yellow, magenta, cyan and black. In the following, the image forming unit PY is described as a typical example, and redundant description on the image forming units PM, PC and PK will be omitted.

The image forming unit PY includes a charging roller 2Y, an exposing device 3, a developing device 4Y, and a primary transfer roller 5Y, each of which is arranged around the photosensitive drum 1Y. The photosensitive drum 1Y has a photosensitive layer formed over the surface of an aluminum cylindrical member. The charging roller 2Y charges the surface of the photosensitive drum 1Y to a uniform potential. The exposing device 3 scans the photosensitive drum 1Y with a laser beam to write an electrostatic image on the photosensitive drum 1Y. The developing device 4Y develops the electrostatic image to form a toner image on the photosensitive drum 1Y. The primary transfer roller 5Y is applied with a voltage to primarily transfer the toner image on the photosensitive drum 1Y to the intermediate transfer belt 8.

<Exterior Door>

Figure 2:
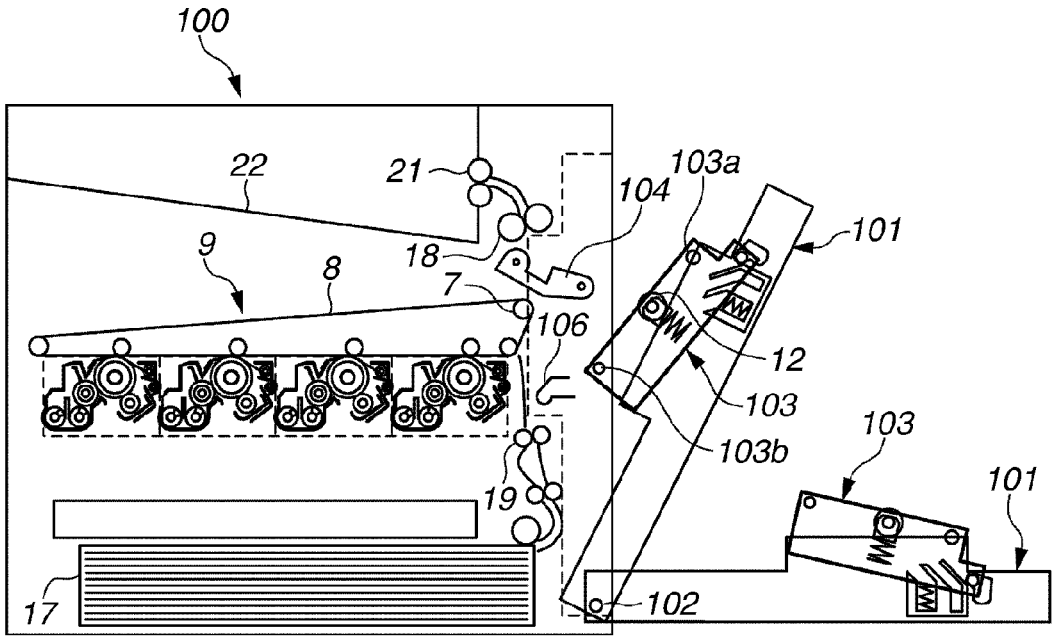
FIG. 2 illustrates an opening and closing movement of an exterior door.

FIG. 2 illustrates an opening and closing movement of an exterior door. An intermediate transfer unit 9 is detachably mounted on a housing frame 100*a* of the image forming apparatus 100 as illustrated in FIG. 1. In the intermediate transfer unit 9, the intermediate transfer belt 8 is supported being laid around on a secondary transfer counter roller 7, a tension roller 8*a*, and a drive roller 8*b*. A secondary transfer roller 12 contacts the outer surface of the intermediate transfer belt 8 of which the inner surface is supported by the secondary transfer counter roller 7 to form a nip portion of the secondary transfer portion T2. The image forming apparatus 100 has an exterior door 101 provided on a side surface thereof, which is capable of opening and closing outward on a rotation center 102. The exterior door 101 is an external member included in a part of the exterior of the image forming apparatus 100. When the exterior door 101 is in the closed state, the secondary transfer roller 12 contacts the intermediate transfer belt 8.

When the exterior door 101 is in the closed state, the exterior door 101 is fixed integrally with a housing structure of the image forming apparatus 100 by a secondary transfer lock arm 104. The secondary transfer roller 12 contacts the intermediate transfer belt 8 to form the secondary transfer portion T2 between the intermediate transfer belt 8 and itself.

when a recording material is jammed, the exterior door 101 can be opened ninety degrees toward outside in a falling manner from the side surface of the image forming apparatus 100 as illustrated in FIG. 2. When the exterior door 101 is in the opened state, the secondary transfer roller 12 is separated from the intermediate transfer belt 8. In other words, when the exterior door 101 is in the opened state, the nip portion between the intermediate transfer belt 8, which is supported by the secondary transfer counter roller 7 at the inner surface thereof, and the secondary transfer roller 12, is released. A wide working space for removing the jammed recording material is thereby ensured. The image forming apparatus 100 is enhanced in an easiness of the jam clearance operation by a user by separating the secondary transfer roller 12 from the intermediate transfer belt 8 accompanying the opening movement of the exterior door 101.

With the configuration discussed in Japanese Patent Application Laid-Open No. 2009-251135, a conveyance path for a recording material is not fully opened when an exterior door is opened since a secondary transfer unit, which supports a secondary transfer roller, is rotatably provided in an image forming apparatus. Accordingly, a recording material positioned at a point before entering a secondary transfer unit is hardly confirmed. When the exterior door is opened by a user for a jam handling, the secondary transfer unit interrupts a part of the conveyance path of the recording material from the view of the user, thus the jammed recording material is hardly recognized.

Therefore, according to the first exemplary embodiment, the secondary transfer unit 103, which is pivotally supported by a rotation center hole 106 on the image forming apparatus 100 side, is disengaged from the rotation center hole 106 in the opening process of the exterior door 101 to be completely held by the exterior door 101 in the opened state.

Figure 3:
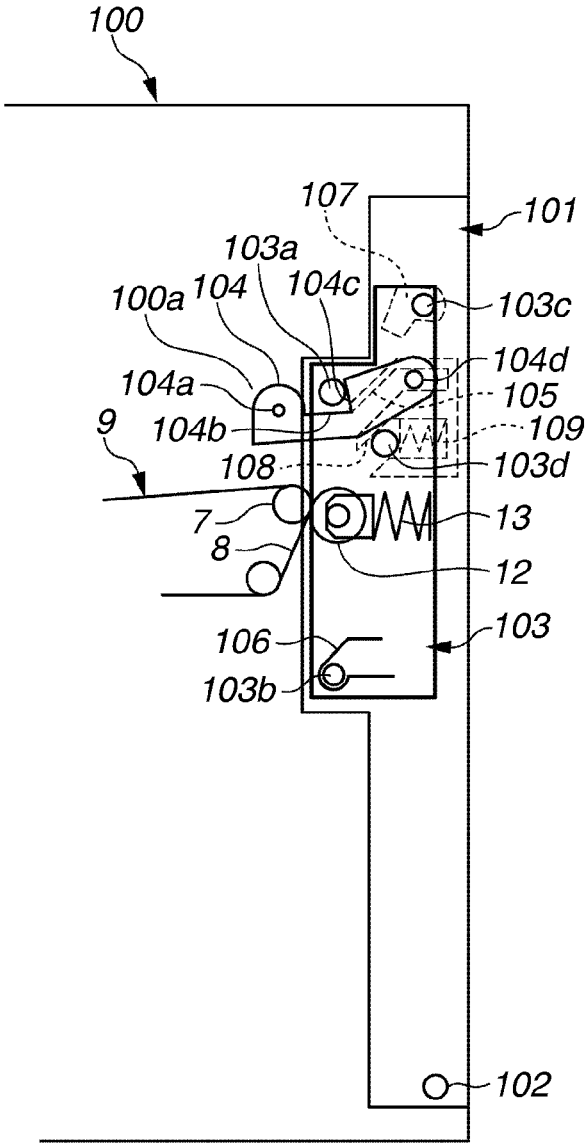
FIG. 3 illustrates a configuration of an exterior door according to a first exemplary embodiment.

FIG. 3 illustrates a configuration of the exterior door according to the first exemplary embodiment. The secondary transfer counter roller 7 as an example of a first roller member is supported by the housing frame 100*a* as an example of a housing side support member of the image forming apparatus 100 as illustrated in FIG. 3. The secondary transfer counter roller 7 supports the inner surface of the intermediate transfer belt 8. The secondary transfer roller 12 as an example of a second roller member contacts the secondary transfer counter roller 7 directly or via the intermediate transfer belt 8 as an example of a belt member to form the nip portion for a recording material. The secondary transfer roller 12 contacts the outer surface of the intermediate transfer belt 8.

The exterior door 101 as an example of a first support member is capable of the opening and closing movement on the rotation center 102 as an example of a first rotation shaft with respect to the housing frame 100*a*. The exterior door 101 is a door member, the upper portion of which is capable of the opening and closing toward outside of the apparatus body around a horizontal rotation center 102 arranged in a lower portion. The secondary transfer unit 103 as an example of a second support member supports the secondary transfer roller 12 and is movably supported within a predetermined range regulated by an upper movement regulating guide 107 with respect to the exterior door 101.

The rotation center hole 106 as an example of a first engaging portion is provided in the housing frame 100*a* as an example of the housing side supporting member. The rotation center hole 106 causes the secondary transfer unit 103 to rotate on a predetermined rotation central axial line of the housing frame 100*a* side to position the secondary transfer roller 12 with respect to the secondary transfer counter roller 7. The predetermined rotation central axial line is arranged parallel to the secondary transfer roller 12 in a lower portion of the secondary transfer unit 103. A rotation center portion 103*b* as an example of a second engaging portion is arranged in the secondary transfer unit 103 to engage with the rotation center hole 106 so that the secondary transfer unit 103 can rotate on the predetermined rotation central axial line.

The rotation center hole 106 and the rotation center portion 103*b* engage with each other accompanying the closing movement of the exterior door 101, and the engagement is released accompanying the opening movement of the exterior door 101. In the engagement state of the rotation center hole 106 and the rotation center portion 103*b*, the secondary transfer unit 103 allows its upper portion to rotate on the lower portion thereof toward the secondary transfer counter roller 7 as an example of the first roller member. In a state that the engagement of the rotation center hole 106 and the rotation center portion 103*b* is released, the secondary transfer unit 103 allows its lower portion to swing toward the exterior door 101 as an example of the first support member while being supported the upper portion thereof by the exterior door 101.

A lower movement regulating guide 108 as an example of a guide mechanism guides the secondary transfer unit 103 accompanying the opening and closing movement of the exterior door 101 to cause a relative movement of the exterior door 101 and the secondary transfer unit 103 within a predetermined range regulated by the upper movement regulating guide 107. Accompanying the closing movement of the exterior door 101, the lower movement regulating guide 108 moves the rotation center portion 103*b* toward the rotation center hole 106 Accompanying the opening movement of the exterior door 101, the lower movement regulating guide 108 disengages the rotation center portion 103*b* from the rotation center hole 106.

A pressure spring 13 as an example of an urging member is arranged between the secondary transfer roller 12 and the secondary transfer unit 103 to urge the secondary transfer roller 12 in a direction away from the secondary transfer unit 103. The pressure spring 13 is compressed accompanying the closing movement of the exterior door 101 after the rotation center hole 106 and the rotation center portion 103*b* are engaged with each other to generate a pressure force between the secondary transfer counter roller 7 and the secondary transfer roller 12.

A secondary transfer lock arm 104 as an example of a lock lever member is rotatably provided in the housing frame 100*a* to fix the exterior door 101 to the housing frame 100*a* in a state that the secondary transfer roller 12 is pushed toward the secondary transfer counter roller 7. A secondary transfer guide 105 as an example of a lock lever guide mechanism is provided in the exterior door 101 to cause the secondary transfer lock arm 104 to rotate at a final stage of the closing movement of the exterior door 101 to fix the secondary transfer unit 103 to the housing frame 100*a*.

The rotation center 102 of the exterior door 101 is provided in the lower end of the exterior door 101. The secondary transfer unit 103 is arranged occupying an area from an intermediate portion to an upper portion of the exterior door 101. The secondary transfer roller 12 is rotatably supported with a rotation shaft which is movable in a direction perpendicular to the secondary transfer unit 103. The pressure spring 13 is arranged between the secondary transfer unit 103 and a bearing portion of the secondary transfer roller 12. The pressure spring 13 pushes the secondary transfer roller 12 toward the secondary transfer counter roller 7.

A cylindrical upper regulating portion 103*c* provided in the secondary transfer unit 103 is restrained with a space by the upper movement regulating guide 107 provided in the upper portion of the exterior door 101. The upper movement regulating guide 107 holds the secondary transfer unit 103 to be movable within a specific range with respect to the exterior door 101. On the exterior door 101, the secondary transfer unit 103 is movable within a specific range regulated by the upper movement regulating guide 107.

A cylindrical lower regulating portion 103*d* provided in the secondary transfer unit 103 engages with the lower movement regulating guide 108 provided in an intermediate portion of the exterior door 101 and is guided. A spring 109 is placed between the lower regulating portion 103*d* and the exterior door 101. The spring 109 pushes the secondary transfer unit 103 toward the image forming apparatus 100 side.

The intermediate transfer unit 9 supporting the secondary transfer counter roller 7 includes the rotation center hole 106 having an obliquely upwards circular opening. The secondary transfer unit 103 supporting the secondary transfer roller 12 is provided with a cylindrical rotation center portion 103*b*. The rotation center hole 106 holds the rotation center portion 103*b* detachably and rotatably. That is, when the exterior door 101 is in the closed state, the secondary transfer unit 103 is positioned at the bottom end thereof by the rotation center hole 106 of which positional relationship is fixed with respect to the secondary transfer counter roller 7.

The housing frame 100*a* of the image forming apparatus 100 includes a secondary transfer lock arm 104 which is rotatably provided in the housing frame 100*a*. The secondary transfer unit 103 includes a cylindrical positioning portion 103*a* fixed in an upper portion thereof. The positioning portion 103*a* engages with the secondary transfer lock arm 104 to lock the secondary transfer unit 103.

The exterior door 101 of the image forming apparatus 100 includes the secondary transfer guide 105 attached for guiding an engagement protrusion 104*d* of the secondary transfer lock arm 104. The secondary transfer guide 105 causes the secondary transfer lock arm 104 to rotate on the rotation center 104*a* accompanying the opening and closing movement of the exterior door 101 to release and engage the secondary transfer lock arm 104 with respect to the positioning portion 103*a*.

The secondary transfer lock arm 104 fixes the upper end of the secondary transfer unit 103 which is rotatable on the rotation center hole 106 to the housing frame 100*a* of the image forming apparatus 100. In the engagement portion 104*b* of the secondary transfer lock arm 104, a contact portion 104*c*, which contacts the positioning portion 103*a* when the exterior door 101 is in the closed state, is formed in a smoothly connected arc-shape centering the rotation center 104*a* of the secondary transfer lock arm 104. The contact portion 104*c* restrains the positioning portion 103*a* by the arc-shape to position the upper portion of the secondary transfer unit 103. Thus, even when a displacement of the rotation position of the secondary transfer lock arm 104 due to dimension tolerance of component parts such as secondary transfer lock arm 104 and the secondary transfer guide 105, no positional displacement of the secondary transfer unit 103 with respect to the image forming apparatus main body 100 is occurred.

Since the contact portion 104*c* of the secondary transfer lock arm 104 is formed to be superimposed, the contact portion 104*c* can apply a large pressure force between the secondary transfer roller 12 and the secondary transfer counter roller 7 with a small rotational force of the secondary transfer lock arm 104. The secondary transfer lock arm 104 strongly pulls the positioning portion 103*a* in conjunction with the closing movement of exterior door 101. A user, therefore, can operate the exterior door 101 with a small force to bring the secondary transfer roller 12 into contact with the intermediate transfer belt 8. In view of recording accuracy of images, the contact pressure of the secondary transfer roller 12 against the intermediate transfer belt 8 is preset to 30-80 N.

The moment generated by the spring 109 on the rotation center portion 103*b* when the exterior door 101 is in the closed state is smaller than the moment generated by the pressure spring 13 on the rotation center portion 103*b*. The reason of this is to suppress the amplitude of the secondary transfer unit 103 accompanying the vibration of the secondary transfer roller 12 during heating processing of images.

<Closing Process>

Figure 4A:
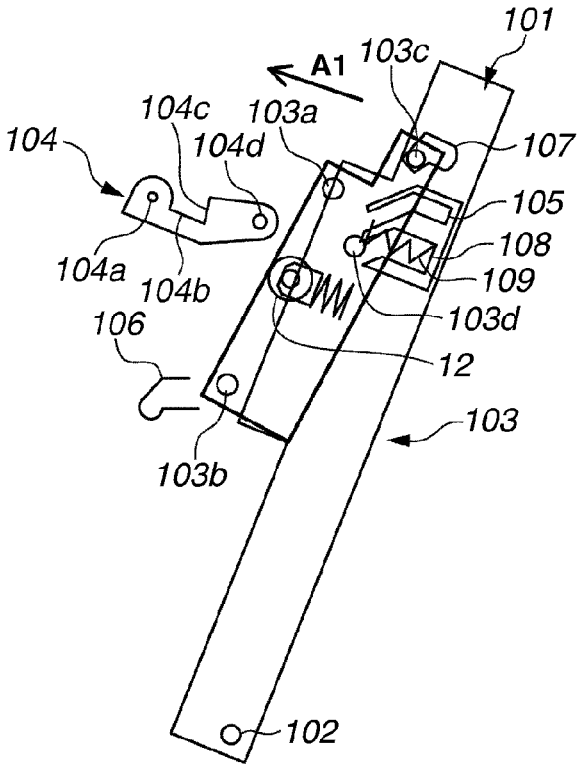
FIGS. 4A and 4B illustrate a closing process of the exterior door.
Figure 4B:
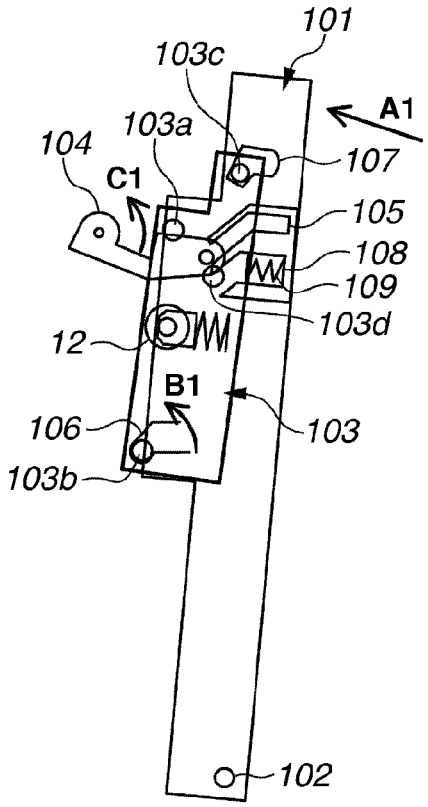

FIGS. 4A and 4B illustrate a closing process of the exterior door 101. After removing a jammed recording material, the user closes the exterior door 101 to set the image forming apparatus 100 in a state ready to perform image forming operation as illustrated in FIG. 4A. In an initial stage of the closing process of the exterior door 101, the lower regulating portion 103*d* of the secondary transfer unit 103 is movable being guided by the lower movement regulating guide 108, and is being urged in a direction of arrow A1 by the spring 109. Consequently, the secondary transfer unit 103 is entirely lifted up in the direction of arrow A1. At the same time, the lower end of the secondary transfer unit 103 is protruded toward the rotation center hole 106 on the lower end of the upper movement regulating guide 107.

Accompanying the closing operation of the exterior door 101, the rotation center portion 103*b* in the lower end area of the secondary transfer unit 103 moves toward the rotation center hole 106 to engage with the rotation center hole 106. In the process that rotation center portion 103*b* moves to the rotation center hole 106, the upper regulating portion 103*c* moves within the upper movement regulating guide 107 relatively freely so as not to interfere with the engagement of the rotation center portion 103*b*.

When the rotation center portion 103*b* completely engages with the rotation center hole 106 as illustrated in FIG. 4B, the upper portion of the secondary transfer unit 103 begins to rotate on the rotation center portion 103*b* within a range that the upper regulating portion 103*c* can move within the upper movement regulating guide 107.

When the exterior door 101 is further rotated in the closing direction, the engagement protrusion 104*d* of the secondary transfer lock arm 104 is restrained by the secondary transfer guide 105 of the exterior door 101 and the secondary transfer lock arm 104 begins to rotate. The secondary transfer lock arm 104 includes the engagement protrusion 104*d*. The secondary transfer lock arm 104 causes the engagement protrusion 104*d* to rotate while being guided by a cam shape of the secondary transfer guide 105. Due to the cam shape of the secondary transfer guide 105, a rotation force of the exterior door 101 is smoothly transmitted to the secondary transfer lock arm 104 to rotate the secondary transfer lock arm 104 in a direction of arrow C1 on the rotation center 104*a*.

The lower regulating portion 103*d* is pushed by the spring 109 to rotate in a direction of arrow B1 until the secondary transfer unit 103 is locked by the secondary transfer lock arm 104. When the exterior door 101 is in the closed state, the engagement portion 104*b* of the secondary transfer lock arm 104 engages with the positioning portion 103*a* of the secondary transfer unit 103. When the arc-shape contact portion 104*c* contacts the positioning portion 103*a* of the secondary transfer unit 103, the secondary transfer unit 103 is positioned with respect to the image forming apparatus 100.

<Opening Process>

Figure 5A:
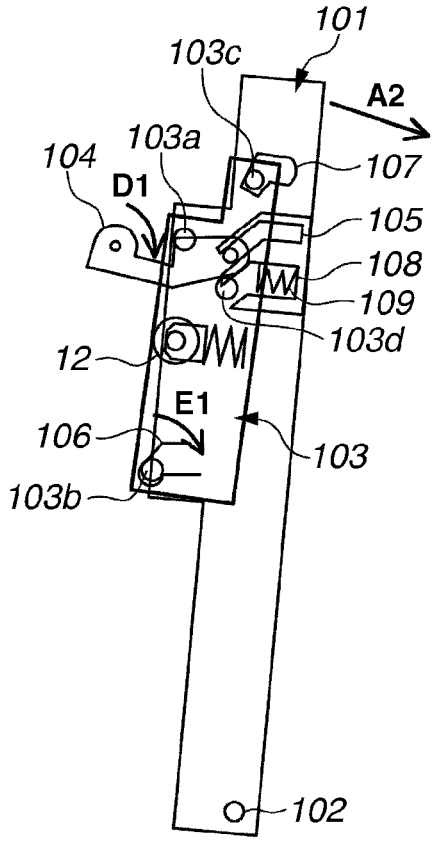
FIGS. 5A and 5B illustrate an opening process of the exterior door.
Figure 5B:
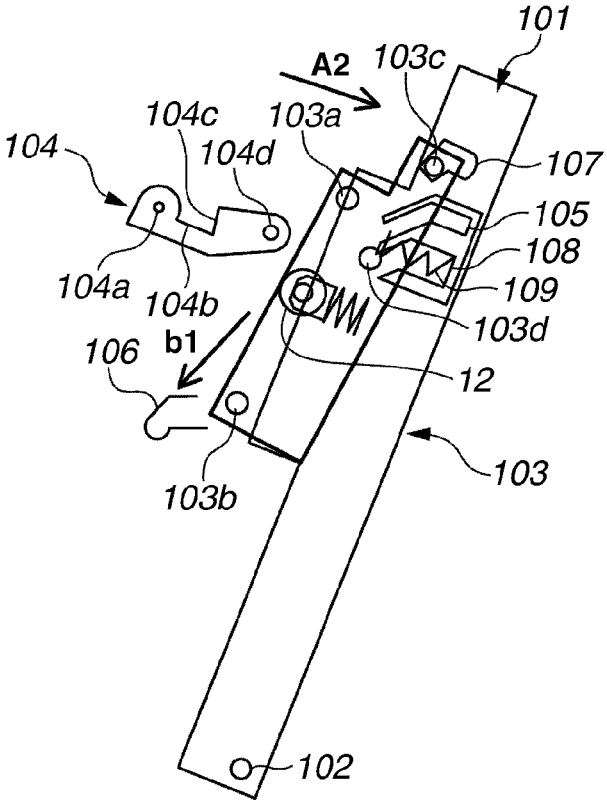

FIGS. 5A and 5B illustrates an opening process of the exterior door 101. The user opens the exterior door 101 of the image forming apparatus 100 to remove a jammed recording material as illustrated in FIG. 5A. The user starts to rotate the exterior door 101 in an opening direction. In an initial stage of the opening process of the exterior door 101, the upper portion of the secondary transfer unit 103 is tilted outward on the rotation center portion 103*b*. Due to the cam shape of the secondary transfer guide 105, a rotation force is transmitted to the secondary transfer lock arm 104 and the secondary transfer lock arm 104 rotates in a direction of arrow D1 on the rotation center 104*a*. The engagement of the engagement portion 104*b* of the secondary transfer lock arm 104 with respect to the positioning portion 103*a* of the secondary transfer unit 103 is released as illustrated in FIG. 5B, and the lock of the secondary transfer lock arm 104 is released. After the lock of the secondary transfer lock arm 104 has been released, the secondary transfer unit 103 rotates in a direction of arrow E1 illustrated in FIG. 5A on the rotation center hole 106 due to a reaction force from the intermediate transfer belt 8. Then, the upper regulating portion 103*c* of the secondary transfer unit 103 is lifted by the upper movement regulating guide 107 of the exterior door 101 and the engagement between the rotation center portion 103*b* and the rotation center hole 106 of the secondary transfer unit 103 is released.

The secondary transfer unit 103 is originally held by the exterior door 101 as illustrated in FIG. 5B. However, in an initial stage of the opening operation of the exterior door 101, the secondary transfer unit 103 rotates along with the exterior door 101 on the rotation center hole 106. After that, the rotation center portion 103*b* is disengaged from the rotation center hole 106 and is widely opened along with the exterior door 101.

According to the first exemplary embodiment, in conjunction with an opening and closing movement of the exterior door 101, the secondary transfer roller 12 and the secondary transfer unit 103 become in a first rotation state and a second rotation state. In the first rotation state, the secondary transfer roller 12 and the secondary transfer unit 103 rotate on the rotation center 102 of the exterior door 101. In the second rotation state, the secondary transfer roller 12 and the secondary transfer unit 103 rotate on the rotation center hole 106 provided in the image forming apparatus 100.

According to the first exemplary embodiment, in the opening process of the exterior door 101, after the second rotation state, a working space wider than a rotation radius of the secondary transfer roller 12 on the rotation center hole 106 is formed between the intermediate transfer belt 8 and the secondary transfer roller 12 with the first rotation state. In the closing process of the exterior door 101, after the first rotation state, the secondary transfer roller 12 rotates on the rotation center hole 106 provided in the image forming apparatus 100 to position parallel to the secondary transfer counter roller 7 with the second rotation state is performed. Between the secondary transfer roller 12 and the secondary transfer counter roller 7, a uniform and highly repetitive distribution of the pressure force is formed along the direction of a rotation shaft.

According to the first exemplary embodiment, since the secondary transfer unit 103 having a relatively small radius of rotation is rotated on the rotation center hole 106, which is close to the secondary transfer portion T2, the secondary transfer unit 103 can be structured in a light weight with high rigidity. Supporting rigidity of the secondary transfer roller 12 becomes high as well. While the size of the image forming apparatus can be reduced, the nipping pressure and the nipping pressure distribution are stably obtained on the secondary transfer portion T2.

According to the first exemplary embodiment, since the conveyance path of the recording material between the secondary transfer unit 103 and the intermediate transfer belt 8 is widely opened, removal work of a jammed recording material can be easily performed. When a recording material is jammed, since the conveyance path is entirely opened, a user can easily recognize the jammed recording material. Since the conveyance path of recording material is widely opened, a user can check the entire conveyance path and thus the operability is excellent.

According to the first exemplary embodiment, similar to Japanese Patent Application Laid-Open No. 2009-251135, the upper portion of the secondary transfer unit 103 is precisely positioned with respect to the image forming apparatus 100 by the function of the secondary transfer lock arm 104, and a user can open and close the exterior door 101 with a small force.

Each of the mechanisms illustrated in FIG. 3 to FIGS. 5A and 5B is provided in a pair in a width direction perpendicular to a conveyance direction of the recording material P. Each of the secondary transfer lock arm 104, the positioning portion 103*a*, the secondary transfer guide 105, the rotation center hole 106, the rotation center portion 103*b*, the upper movement regulating guide 107, the spring 109, and the upper regulating portion 103*c* is provided in a pair in the width direction perpendicular to the conveyance direction of the recording material P. The housing frame as a framework of the image forming apparatus 100 and the component parts supporting the intermediate transfer unit 9 have a sufficient strength, and are designed to have a thickness conforming to a positional reference of the entire image forming apparatus.

According to the first exemplary embodiment, a compression spring is used for the spring 109. However, the compression spring may be replaced with a torsion coil spring. According to the first exemplary embodiment, the image forming apparatus 100 includes the rotation center hole 106 and the secondary transfer lock arm 104. However, the intermediate transfer unit 9 may include the rotation center hole 106 and the secondary transfer lock arm 104.

According to the first exemplary embodiment, the rotation center hole 106 has a shape with the top opened. However, the rotation center hole 106 may be formed in an elongated hole so as to hold the cylindrical positioning portion 103*a* from top and bottom, which is provided in the secondary transfer unit 103, and thereby reliably guide the positioning portion 103*a* to the rotation center hole 106 by regulating the movement path of the positioning portion 103*a*.

According to the first exemplary embodiment, the upper regulating portion 103*c*, the lower regulating portion 103*d*, and the positioning portion 103*a* are arranged at a position higher than the secondary transfer roller 12, and the rotation center portion 103*b* is arranged at a position lower than the secondary transfer roller 12.

Figure 6:
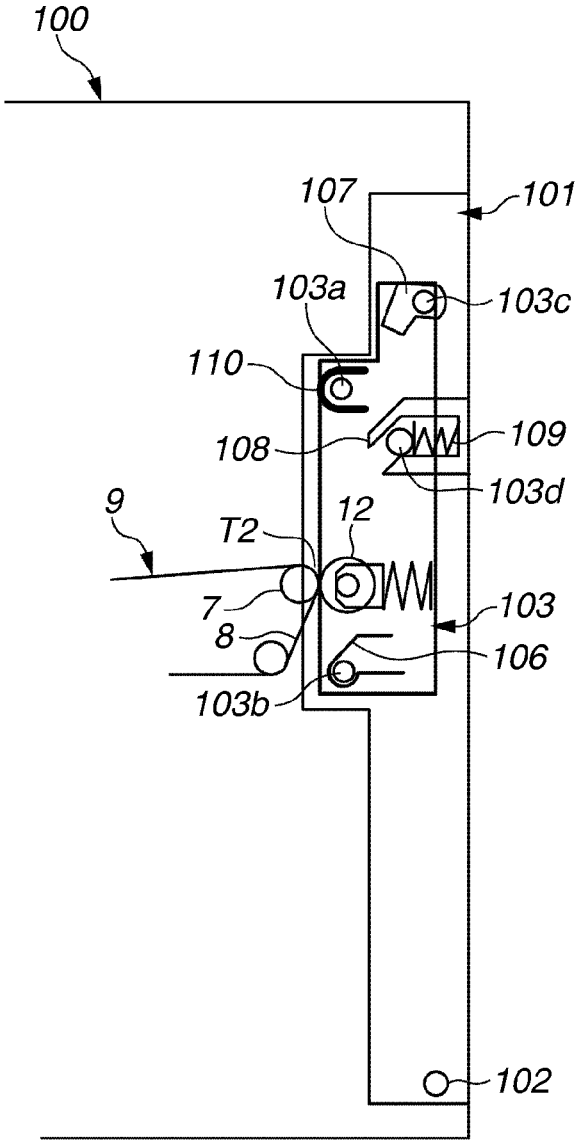
FIG. 6 illustrates a configuration of an exterior door according to a second exemplary embodiment.
Figure 7A:
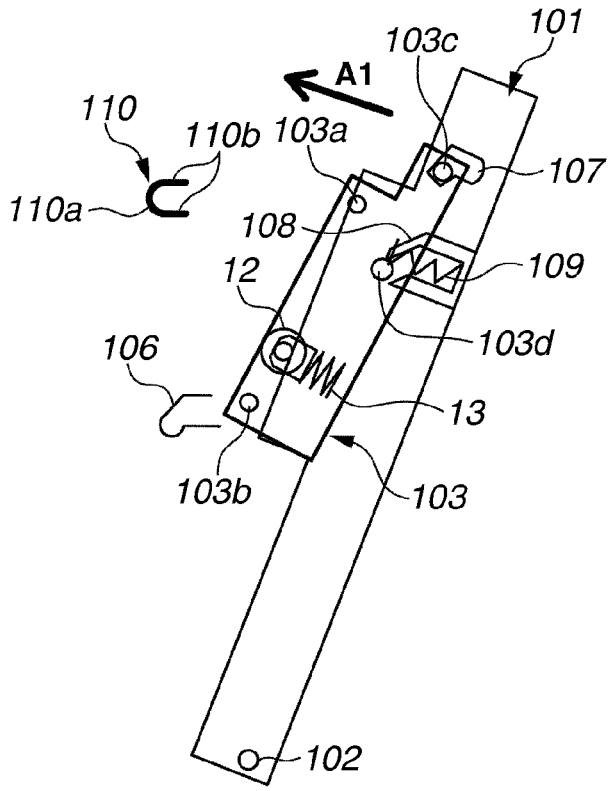
FIGS. 7A and 7B illustrate a closing process of an exterior door according to the second exemplary embodiment.
Figure 7B:
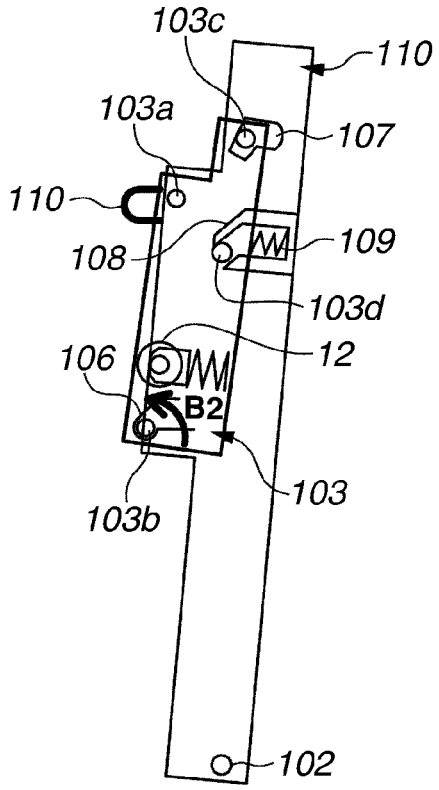

FIG. 6 illustrates a configuration of an exterior door 101 according to a second exemplary embodiment. FIGS. 7A and 7B illustrate a closing process of an exterior door 101. The second exemplary embodiment has a configuration substantially similar to that of the first exemplary embodiment excepting a point that a positioning hole 110 is provided instead of the secondary transfer lock arm 104 in the first exemplary embodiment. Therefore, the components in FIG. 6, FIGS. 7A and 7B, which are identical to those in the first exemplary embodiment, are given with reference numerals identical to those in FIG. 3, FIGS. 4A and 4B, FIGS. 5A and 5B, and redundant descriptions thereof will be omitted.

A secondary transfer roller 12 contacts an intermediate transfer belt 8 supported by a secondary transfer counter roller 7 at the inner surface side to form a secondary transfer portion T2 as illustrated in FIG. 6. A lower portion of the secondary transfer unit 103, which supports the secondary transfer roller 12 to be movable in a protruding direction, is pivotally supported by a rotation center hole 106 opened upward to position the secondary transfer roller 12 parallel to the secondary transfer counter roller 7.

An image forming apparatus 100 includes a positioning hole 110 as a positioning portion of the secondary transfer unit 103 causing the upper portion of the secondary transfer unit 103 to rotate on the rotation center hole 106. The positioning hole 110 includes an engagement portion 110*a* having an arc-shape which engages with a positioning portion 103*a* and a guide portion 110*b* that smoothly guides the positioning portion 103*a* into the engagement portion 110*a*.

When the exterior door 101 is in a closed state, the positioning hole 110 engages with the positioning portion 103*a*, which has a cylindrical shape provided in the secondary transfer unit 103, to fix the posture and the position of the secondary transfer unit 103. In a state that the positioning portion 103*a* abuts on the positioning hole 110, the exterior door 101 is fixed and positioned with respect to the image forming apparatus 100.

After removing a jammed recording material, a user closes the exterior door 101 as shown in FIG. 7A to set the image forming apparatus 100 ready to perform image forming operation. The secondary transfer unit 103 is rotated in a closing direction along with the exterior door 101 in a state that the lower end portion is protruded toward the image forming apparatus 100 from the exterior door 101 being pushed by a spring 109.

The secondary transfer roller 12 and the secondary transfer unit 103 rotate on the rotation center 102 of the exterior door 101 to move toward the intermediate transfer unit 9. In the process above, the lower movement regulating guide 108 guides the lower regulating portion 103*d* so that the rotation center portion 103*b* of the secondary transfer unit 103 is guided to the rotation center hole 106.

When the rotation center portion 103*b* of the secondary transfer unit 103 engages with the rotation center hole 106 as illustrated in FIG. 7B, the secondary transfer roller 12 and the secondary transfer unit 103 rotate on the rotation center hole 106 provided in the image forming apparatus 100. The secondary transfer unit 103 rotates on the rotation center portion 103*b* which is held by the rotation center hole 106 in a direction of arrow B2, and gradually moves toward the exterior door 101 while compressing the spring 109. Accompanying the closing operation of the exterior door 101, the secondary transfer unit 103 is pushed until the positioning portion 103*a* abuts on the positioning hole 110.

When the exterior door 101 is in the closed state, a moment generated by the spring 109 on the rotation center portion 103*b* is larger than a moment generated by the pressure spring 13 on the rotation center portion 103*b*. The reason of this is to suppress the amplitude of the secondary transfer unit 103 accompanying the vibration of the secondary transfer roller 12 during performing image heat processing.

When the exterior door 101 is opened to perform a removal work of a jammed recording material, a user rotates the exterior door 101 in an opening direction. The secondary transfer unit 103 rotates on the rotation center hole 106 due to a reaction force from the intermediate transfer belt 8. Subsequently, the upper regulating portion 103*c* of the secondary transfer unit 103 is lifted up by the upper movement regulating guide 107 of the exterior door 101, and the secondary transfer unit 103 moves upward to release the engagement between the rotation center portion 103*b* and the rotation center hole 106 is released. Subsequently, the secondary transfer unit 103 rotates along with the exterior door 101 on the rotation center 102 to form a wide working space between the secondary transfer roller 12 and the intermediate transfer belt 8.

In the second exemplary embodiment, similar to the first exemplary embodiment, the upper regulating portion 103*c*, the lower regulating portion 103*d*, and the positioning portion 103*a* are arranged at a position higher than the position of the secondary transfer roller 12. The rotation center portion 103*b* is arranged at a position lower than the position of the secondary transfer roller 12. However, the secondary transfer roller 12 according to the second exemplary embodiment is arranged closer to the lower regulating portion 103*d* than the secondary transfer roller 12 according to the first exemplary embodiment to reduce the closing reaction force of the exterior door 101 generated by a moment generated by the pressure spring 13 on the lower regulating portion 103*d*. The reason of this is that no mechanism is provided to amplify the closing force such as the secondary transfer lock arm 104.

Figure 8:
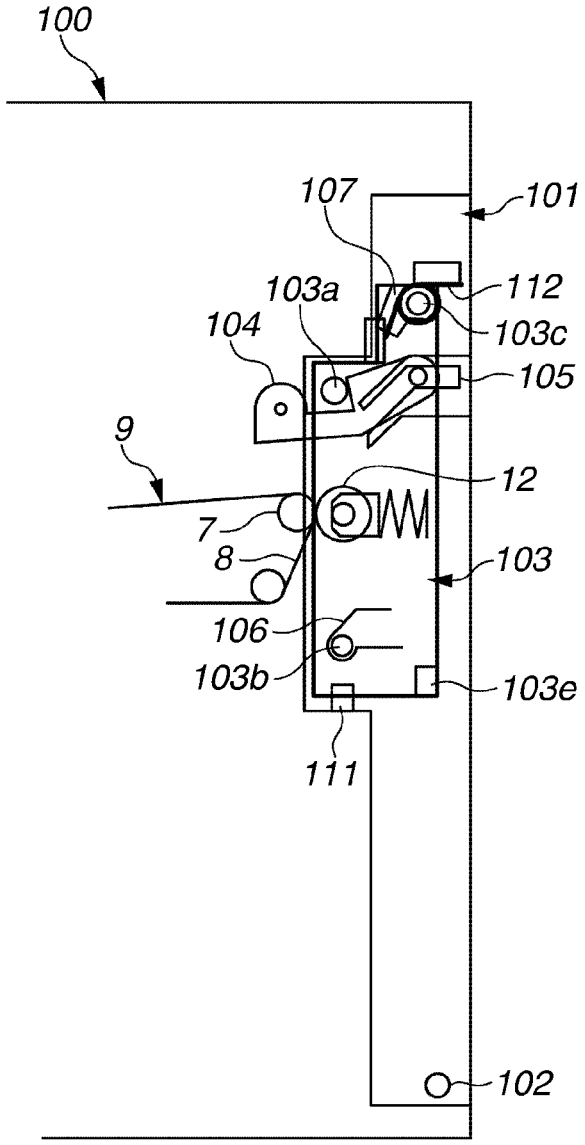
FIG. 8 illustrates a configuration of an exterior door.
Figure 9A:
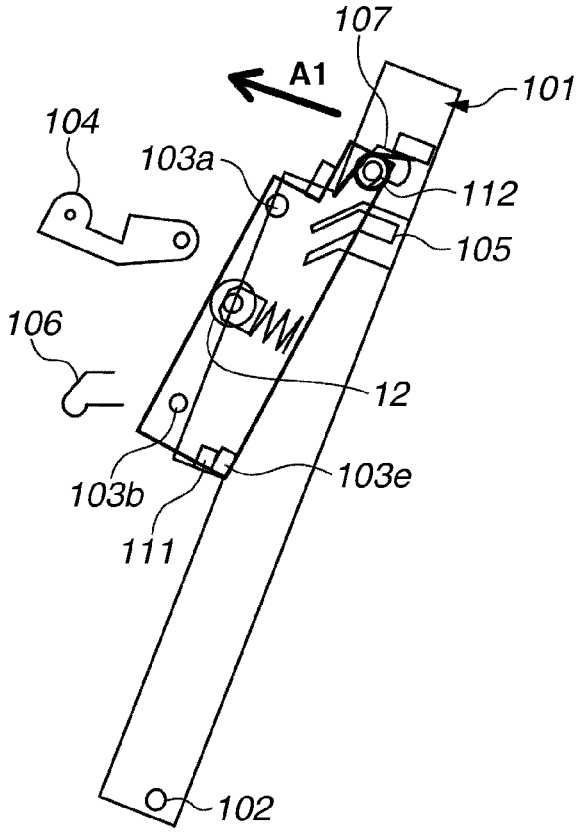
FIGS. 9A and 9B illustrate a closing process of the exterior door.
Figure 9B:
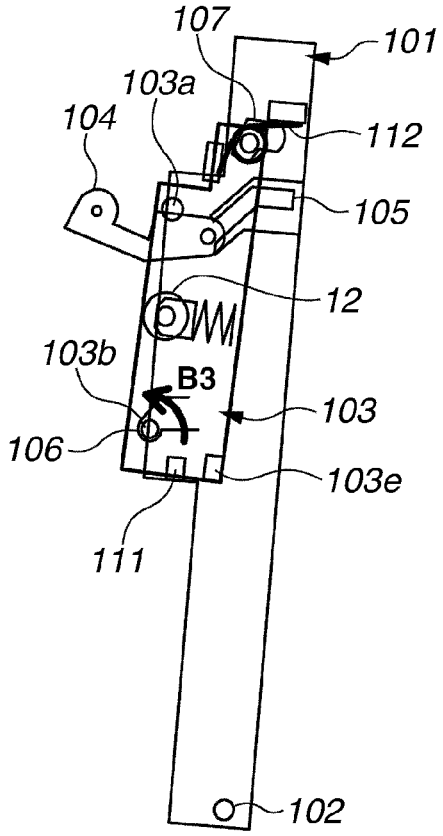

FIG. 8 illustrates a configuration of an exterior door 101 according to a third exemplary embodiment. FIGS. 9A and 9B illustrate a closing process of the exterior door 101. The configuration according to the third exemplary embodiment is substantially similar to the configuration according to the first exemplary embodiment excepting a point that a torsion coil spring 112 is provided instead of the spring 109. Therefore, the components identical to those according to the first exemplary embodiment in FIG. 8, FIGS. 9A and 9B are given with reference numerals identical to those in FIG. 3, FIGS. 4A and 4B, FIGS. 5A and 5B, and redundant descriptions thereof will be omitted.

In a secondary transfer unit 103 illustrated in FIG. 8, a movable range of an upper regulating portion 103*c* is regulated by an upper movement regulating guide 107 formed in an exterior door 101. A lower rotation regulating portion 103*e* contacts a lower rotation regulating guide 111 formed in the exterior door 101 so that the rotation range of the secondary transfer unit 103 on the upper regulating portion 103*c* is regulated.

The upper regulating portion 103*c* includes a torsion coil spring 112 on a shaft thereof. The torsion coil spring 112 pushes the secondary transfer unit 103 toward the image forming apparatus 100 to protrude the secondary transfer unit 103 from the exterior door 101. Each of the torsion coil spring 112, the lower rotation regulating guide 111, and the lower rotation regulating portion 103*e* is provided in a pair in a width direction perpendicular to a conveyance direction of recording material P.

In the third exemplary embodiment, similar to the first exemplary embodiment, the upper regulating portion 103*c* and the positioning portion 103*a* are arranged at a position higher than the secondary transfer roller 12. The rotation center portion 103*b* and the lower rotation regulating portion 103*e* are arranged at a position lower than the secondary transfer roller 12.

Figure 10:
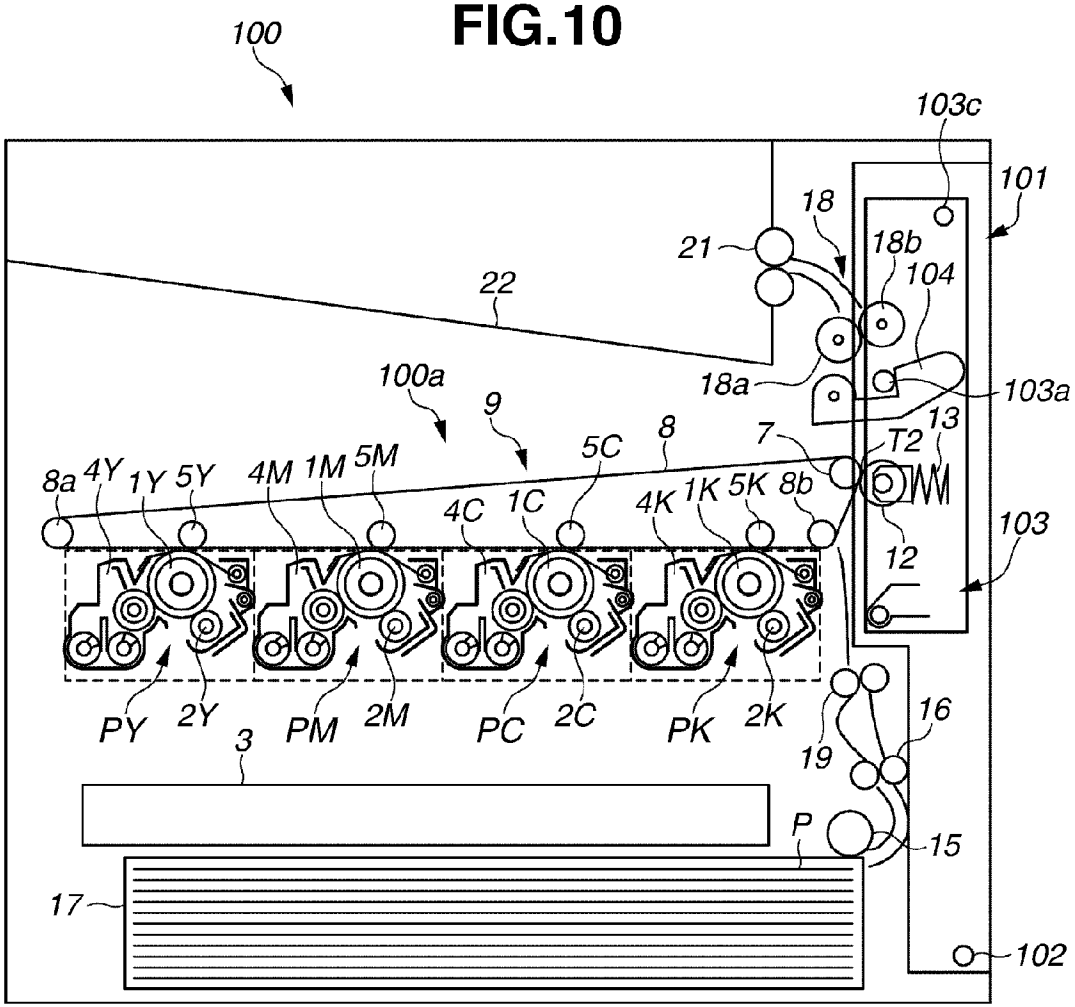
FIG. 10 illustrates a configuration of an image forming apparatus according to a fourth exemplary embodiment.

FIG. 10 illustrates a configuration of an image forming apparatus according to a fourth exemplary embodiment. The exemplary embodiments of the present invention can also be implemented in a secondary transfer unit of a toner image, a transfer unit of a toner image or a nip portion of a fixing device.

As illustrated in FIG. 10, a first roller member may be a heating roller 18*a* for heating image surface of a recording material. A second roller member may be a pressure roller 18*b* forming a nip portion for a recording material by contacting the heating roller 18*a*. A secondary transfer unit 103 is expanded to an area upper than that in the first exemplary embodiment illustrated in FIG. 1. Engagement and positioning between a secondary transfer unit 103 and a main body of an image forming apparatus 100 is performed using a configuration similar to the above-described exemplary embodiments.

With the opening operation of the exterior door 101, the pressurizing roller 18*b* of the fixing device 18 is separated along with a secondary transfer roller 12 to open the nip portion for the recording material in a wider range.

The present invention can be implemented in another exemplary embodiment in which the entire or a part of the configuration of the above-described exemplary embodiments is replaced with an alternative configuration insofar as a rotation center of a secondary transfer roller moves toward a secondary transfer counter roller side from an image forming apparatus side accompanying an opening operation of an exterior door. Therefore, an image forming apparatus of single drum intermediate transferring system, in which a plurality of developing devices is brought into contact with a photosensitive drum in order, is also applicable. An image forming apparatus of a recording material conveyance type, in which a recording material conveyance belt is brought into contact with a plurality of photosensitive drums, is also applicable. The number of detachable process cartridges in the exemplary embodiment may be four or more, if necessary. The process cartridge may not include a photosensitive drum, a charging device, a developing device or a drum cleaning device as a unit. A process cartridge may include, in addition to a photosensitive drum, any one of a charging device, a developing device, and a drum cleaning device. A process cartridge including a photosensitive drum may not be detachable with respect to an image forming apparatus. An image forming apparatus may include a photosensitive drum and process units, each of which is incorporated or is detachable.

An image heating device includes, in addition to a fixing device, a semi-fixing device or a surface heating device for adjusting gloss or surface feature of a fixed image. A curl removal device for recording material on which fixed image formed is also included. An image heating device may be implemented as a single installed operation unit or a component unit without incorporating with an image forming apparatus. An image forming apparatus can be implemented in any of monochrome or full color, sheet type, recording material conveyance type or intermediate transfer type, toner image forming type. The exemplary embodiments of the present invention can be implemented in an image forming apparatus of various purposes such as printers, various printing machines, copiers, facsimiles, or multifunction peripherals by adding necessary devices, accessories or housing structures.

In the image forming apparatus according to the exemplary embodiments of the present invention, while a space for removing a jammed recording material is ensured since the door member is opened in a state the transfer unit is supported by the door member, the door can be pushed in with a small force when closing the door member since the transfer unit is rotated on the second rotation center and the door member is locked by the lock lever.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-255108 filed Nov. 21, 2012, which is hereby incorporated by reference herein in its entirety.

What is claimed is:

1. An image forming apparatus, comprising:

a first roller supported by a main body of the image forming apparatus;

a second roller configured to contact the first roller directly or via a belt member to form a nip portion nipping a recording material;

a door member configured to be opened and closed with respect to the main body, an upper portion of the door member being rotatable around a first rotation axis to outside the main body;

a transfer unit disposed in the door member in a state relatively movable with respect to the door member, configured to support the second roller;

an urging member provided between the second roller and the transfer unit to urge the second roller toward the first roller when the door member is closed;

a first positioning portion provided in the main body for determining a relative positional relationship between a lower portion of the transfer unit and the main body in a state that the door member is closed;

a second rotation axis provided in the transfer unit, configured to engage with the first positioning portion to cause the transfer unit to be rotatable around the second rotation axis in the course of closing the door member, and the second rotation axis is located so that the second roller contacts the first roller directly or via the belt member during a rotation of the transfer unit around the second rotation axis, in the course of closing the door member;

a lock lever provided in the main body to lock the door member to the main body in a closed state; and a lock lever guide mechanism provided in the door member to move and guide the lock lever in a process of the closing movement of the door member.

2. The image forming apparatus according to claim 1, further comprising:

a transfer unit urging member arranged between the transfer unit and the door member to urge the transfer unit in a direction away from the door member; and a regulating portion arranged in the door member to regulate the upper portion of the transfer unit within a predetermined range, wherein the urging member moves the lower portion of the transfer unit in a direction away from the door member around the regulating portion in a process that an engagement between the first positioning portion and the second rotation axis is released accompanying an opening movement of the door member.

3. The image forming apparatus according to claim 1, further comprising a second positioning portion arranged in the upper portion of the transfer unit to determine a relative positional relationship between the upper portion of the transfer unit and the main body in a state that the door member is closed, wherein the lock lever includes a protruding portion guided by the guide mechanism and a contact portion, which contacts the second positioning portion, and is rotatable around a third rotation axis, and wherein the guide mechanism guides the protruding portion of the lock lever to rotate the lock lever around the third rotation axis accompanying the closing movement of the door member to cause the second positioning portion to contact the contact portion.

4. The image forming apparatus according to claim 1, wherein the second roller is arranged between the second rotation axis and the second positioning portion.

5. The image forming apparatus according to claim 1, wherein the belt member is an intermediate transfer belt that temporally bears a toner image before the toner image is transferred to a recording material, wherein the first roller is a transfer counter roller for stretching the intermediate transfer belt thereon, and wherein the second roller is a transfer roller contacting an outer surface of the intermediate transfer belt.

6. The image forming apparatus according to claim 1, wherein the first roller is a heating roller heating an image surface of the recording material, and wherein the second roller is a pressure roller contacting the heating roller.

* * * * *